United States Patent [19]

Hossfeld

[11] 4,347,802

[45] Sep. 7, 1982

[54] SELF-BURYING ANCHOR SYSTEM

[76] Inventor: William R. Hossfeld, 3 Pine Ct., Kentfield, Calif. 94904

[21] Appl. No.: 150,925

[22] Filed: May 19, 1980

[51] Int. Cl.[3] ..... B63B 21/26

[52] U.S. Cl. ..... 114/295; 114/298

[58] Field of Search ..... 114/295, 296, 298; 52/155, 158; 405/224, 226

[56] References Cited

U.S. PATENT DOCUMENTS

| | | | |
|---|---|---|---|
| 1,315,721 | 9/1919 | Hall | 114/295 X |
| 3,850,128 | 11/1974 | Lovell | 114/295 |
| 4,038,934 | 8/1977 | Thomson | 114/298 |
| 4,076,313 | 2/1978 | Sperandeo | 114/295 X |
| 4,312,289 | 1/1982 | Conrad | 114/295 |

*Primary Examiner*—Sherman D. Basinger

*Attorney, Agent, or Firm*—Flehr, Hohbach, Test, Albritton & Herbert

[57] ABSTRACT

An anchor device adapted to be buried in a bed of material and including an anchor head comprising a generally hollow cylindrical body having an upper portion adapted to be releasably secured to a hollow placement stem connected to a supply of fluid under pressure. A lower portion of the anchor head has a tapered nose and at least one downwardly oriented jet aperture is provided in the lower end of the nose and a plurality of upwardly-angled jet apertures are provided in the walls of the nose for transmitting fluid into the bed material surrounding the nose to fluidize the material and drive the head into the bed. A fin assembly is mounted on the anchor head intermediate the top and bottom portions and comprises a plurality of fins and a collar and bracket arrangement for mounting a foot portion of each of the fins for rotation between a folded position generally parallel to the axis of the anchor head and an unfolded position at a substantial acute angle to the axis. An anchor line assembly is provided including an anchor line and a ring and cable arrangement fastening the anchor line to the fin assembly to enable the anchor head and fin assembly to be partly retracted from the bed to unfold the fins and thereby set the anchor device in the bed. A placement stand assembly is provided for the anchor and includes a horizontal table with an aperture therethrough receiving the placement stem. The placement stand assembly is adapted to rest on the surface of the bed of material for holding the placement stem in a vertical position as the anchor assembly and placement stem are being driven into the bed. Cooperative screw threads are carried on the distal end of the placement stem and on an upper portion of the anchor assembly for releasably connecting the placement stem and anchor assembly. A stop plate is carried on the placement stem at a preselected distance from the distal end for stopping the burying of the anchor assembly when the stop plate encounters the table on the placement stand assembly. A spring powered turntable is carried on the table and is operable by the stop plate for separating the screw threads to separate the anchor assembly and the placement stem.

10 Claims, 7 Drawing Figures

SELF-BURYING ANCHOR SYSTEM

This invention relates generally to anchor devices which are adapted to be buried in a bed of material. More specifically, this invention relates to anchor devices which have a self-burying capability in a fluidizable bed of materials.

Self-burying anchoring devices have been taught in the prior art, for example, in Nixon U.S. Pat. No. 4,086,866 and Kerr U.S. Pat. No. 4,095,550. The concept of self burying is also employed in underwater recovery apparatus as taught in Sperando U.S. Pat. No. 4,076,313. The prior art anchoring devices which utilize the self-burying concept are generally of relatively complicated construction and are thus relatively expensive to manufacture.

It is a principal object of this invention to provide a self-burying anchor device of simplified, inexpensive construction.

It is a further object of this invention to provide a self-burying anchor system which can be deployed in an underwater bed of material without requiring the assistance of divers to position and hold the self-burying anchor device.

In accordance with one aspect of this invention, the foregoing objects are achieved in an anchor device which includes an anchor head comprising a generally hollow cylindrical body having a top portion adapted to be releasably secured to a hollow placement stem connected to a supply of fluid under pressure and a bottom portion with a tapered nose and at least one downwardly oriented jet aperture in the lower end of the nose and a plurality of upwardly angled jet apertures in the walls thereof for transmitting the fluid into the bed of material surrounding the nose, thereby to fluidize the material and drive the head into the bed. The anchor device further includes a fin assembly mounted on the anchor head intermediate the top and bottom portions thereof and comprising a plurality of fins and means for mounting a foot portion of each of the fins for rotation of the fins between a folded position generally parallel to the axis of the anchor head and an unfolded position at a substantial acute angle to that axis. The anchor device further includes an anchor line assembly including an anchor line and means fastening the anchor line to the fin assembly to enable the anchor head and fin assembly to be partly retracted from the bed to unfold the fins and thereby set the anchor device in the bed.

In a preferred embodiment of the anchor device according to this invention, the mounting means in the fin assembly comprises a fin mounting collar secured to the body of the anchor head and a plurality of fin mounting brackets provided on the collar, each associated with one of the fins and including fastener means for rotationally mounting the foot portion of the associated fin on the bracket. Also in a preferred embodiment of an anchor device according to this invention, the fastening means in the anchor line assembly includes an anchor ring fastened to the anchor line and adapted to encircle the placement stem and at least one coupling line fastened on one end to the anchor ring and on the other end to the fin assembly. In a preferred embodiment, the anchor line assembly further comprises an anchor removal line having a split distal end section comprising individual lines each attached on one end to an associated one of the fins at an intermediate point thereof and passing over the anchor ring to a merger point on the anchor removal line, and means mounted on the fin mounting collar for feeding the anchor removal line from the merger point to a proximal location such that the anchor removal line may be pulled to return the fins to a folded position for easier removal of the anchor device from the bed of material. Preferably, the hollow placement stem includes a transversely extending stop plate fastened thereto at a preselected distance from the anchor head to determine a maximum burying depth for the anchor device.

In accordance with another aspect of this invention, a self-burying anchor system is provided and features a generally hollow anchor placement stem adapted to be connected at a proximal end to a hose supplying a volume of fluid under pressure, a burying anchor assembly carried on a distal end of the anchor placement stem for receiving the volume of fluid under pressure to drive the anchor assembly and the placement stem into a bed of material, and a placement stand assembly including a horizontal table with an aperture therethrough receiving the placement stem with the placement stand adapted to rest on the surface of the bed of material for holding the placement stem in a vertical position as the anchor assembly and placement stem are being driven into the bed. The system further includes cooperative connecting means carried on a distal end of the placement stem and on an upper portion of the anchor assembly for releasably connecting the placement stem and the anchor assembly. A stop means is carried on the placement stem at a preselected distance from the distal end thereof for stopping the burying of the anchor assembly when the stop means encounters the table on the placement stand. A releasing means is carried on the table and operable by the stop means for releasing the cooperative connecting means to separate the anchor assembly and the placement stem.

In a preferred embodiment of a self-burying anchor system in accordance with this invention, the cooperative connecting means comprises cooperative screw threads on the distal end of the placement stem and the upper portion of the anchor assembly for connecting the placement stem in the anchor assembly while the anchor assembly is driving into the bed. In this preferred embodiment, the releasing means comprises a turntable, means for mounting the turntable in rotatable fashion on the table, means carried on the turntable for locking the turntable and the stop means together when the stop means encounters the turntable, spring motor means operable to rotate the turntable and the stop means when locked together, and actuator means for initiating rotation of the turntable by the spring motor means as the stop means encounters the turntable, thereby to unscrew the cooperative screw threads on the placement stem in the anchor assembly and disconnect the two units.

The anchor device of this invention has the advantage of simple but effective structure for achieving a self-burying anchor function. When utilized with the placement stand which provides for automatic disengagement of the placement stem and the anchor device, the invention provides the advantage of a hands-off placement of the anchor device and holding of the placement stem while the anchor device is burying itself into the bed of materials in response to the pressurized fluid supplied thereto. The anchor device and system according to this invention can be utilized for both advantageous in underwater applications for relative permanent mooring of platforms, rafts, barges, and signalling and boat mooring buoys. On dry land the anchor can be used as a dead man cable anchor. The self-burying anchor can be either permanent or removable. The optional anchor removal line may be provided to assist in removal if and when desired.

Other objects, features, and advantages of this invention will be apparent from a consideration of the detailed description given below in conjunction with the accompanying drawings.

Figure 1:
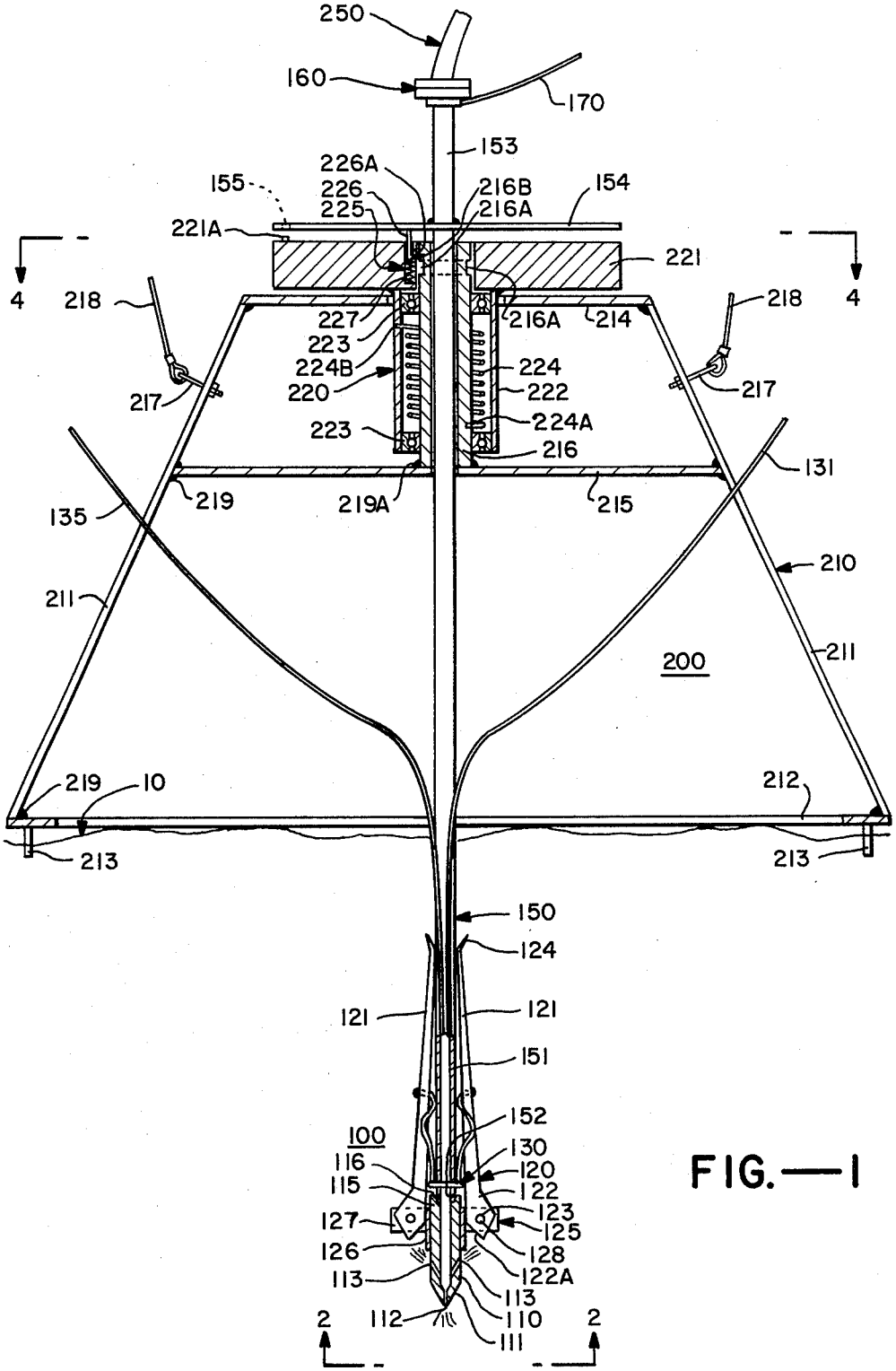
FIG. 1 is a partly sectioned elevational view of an anchor device in accordance with this invention forming part of a self-burying anchor system in accordance with this invention.

Referring now to FIG. 1, a self-burying anchor system in accordance with this invention, is depicted as including the following components:

a self-burying anchor assembly 100,
an anchor placement stem 150, and
an anchor placement stand assembly 200.

Figure 2:
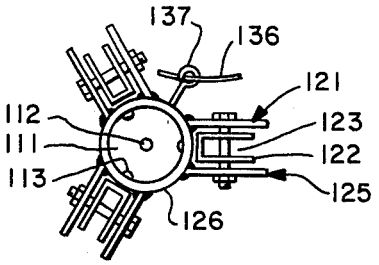
FIG. 2 is a plan view of the anchor device according to this invention taken along the line 2—2 in FIG. 1.
Figure 3:
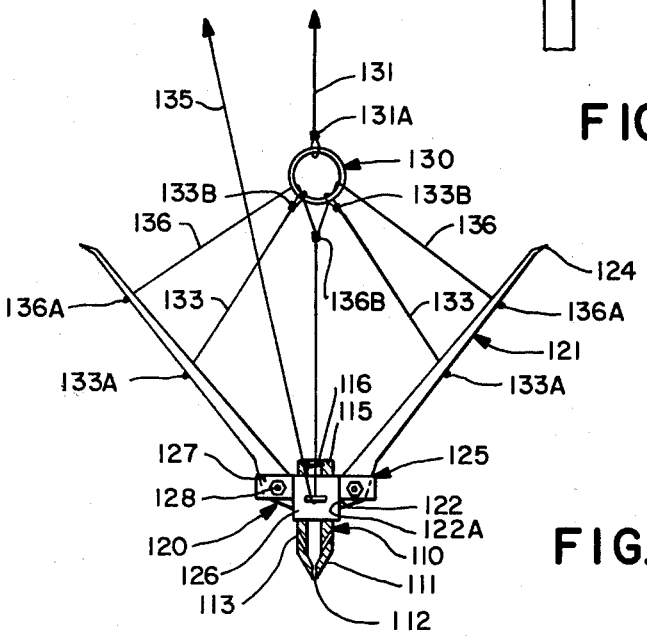
FIG. 3 is an elevational view of an anchor device in accordance with this invention in a set position in a bed of material.

Consider first the structure and function of the self-burying anchor assembly 100 which can best be understood by considering FIGS. 1, 2, and 3 together. Anchor assembly 100 consists essentially of the following components: an anchor head 110, a fin assembly 120, and an anchor line assembly 130. Anchor head 110 is a generally hollow cylindrical body having a lower portion 111 with a tapered nose and a downwardly oriented jet aperture 112 extending through the lower end of the nose. A plurality of upwardly angled jet apertures 113 are provided in the walls of lower head portion 111. The upper portion 115 of anchor head 111 has internal screw threads 116 formed therein so that anchor head 110 may be releasably secured to placement stem 150 utilizing the cooperating external threads 152 formed thereon. Threads 116 and 152 preferably involve one-and-a-half or two complete threads so that relatively few turns of the placement stem are required to disconnect the head 110 therefrom. As will later be seen, this is especially advantageous when utilizing the placement stand feature of automatic disconnecting of the anchor head 110 from the placement stem 150. Where this feature is not provided, the number of threads on the anchor head and placement stem could be increased, but one and a half or two threads would be sufficient in any event since the threads are not required to withstand a substantial pulling force. In addition, a sealing washer (not shown) may be provided at the cooperative thread connecting point if desired, although leakage of fluid at this coupling point is not critical.

Fin assembly 120 includes a plurality of fins 121 and a mounting means, generally designated 125, for mounting a foot portion 122 of each of fins 121 for rotation between a folded position generally parallel to the axis of anchor head 110 as depicted in FIG. 1 and an unfolded position at a substantial acute angle to that axis as depicted in FIG. 3. Mounting means 125 includes a fin mounting collar 126 and a plurality of fin mounting brackets 127 provided on the collar. Each of the fin mounting brackets 127 is associated with one of the fins 121 and includes a fastener means 128 which may be any appropriate type such as a nut and bolt arrangement as depicted in FIG. 2. The fastener means 128 and the mounting bracket 127 rotationally mount the foot portion 122 of fins 121 on collar 126. A wall section 122A on the foot portions 122 of fins 121 forms an acute angle with the longitudinal axis of the fin to serve as a fin stop means for setting the maximum unfolded angle of the fin when the angular wall portion 122A abuts the fin mounting collar 126 as depicted in FIG. 3.

Fin mounting collar 126 may be secured to anchor head 110 in any suitable manner such as by riveting or welding. Anchor head 110 may be constructed out of inexpensive cast pot metal which will act as a dissolving portion for cathodic protection for the fin assembly which is preferably formed a noncorroding material such as galvanized steel. The structure of anchor line assembly is most clearly depicted in FIG. 3. Anchor line assembly 130 includes anchor line 131 which is fastened to anchor ring 132. Coupling lines 133 connect anchor ring 132 to individual ones of fins 121 of fin assembly 120. Any suitable means may be utilized for coupling anchor line 131 to anchor ring 132 such as loop arrangement 131A. Similarly, the respective ends of coupling lines 133 can be fastened to anchor ring 132 by way of loop arrangements 133B and to individual fins 121 by means of a sleeve 133A which is swaged on the end of the coupling lines 133. Of course, numerous other suitable fastening arrangements could be utilized at each of these points. In addition, the coupling lines 133 could be connected between the anchor ring 132 and the fin mounting collar 126 or to the fin mounting brackets 127. Anchor line 131 will be utilized to connect anchor assembly 100 to the object to be anchored such as a raft or mooring buoy.

Anchor line assembly 130 may include an anchor removal line 135 in installations where removal of the anchor at sometime may be desired. Anchor removal line 135 is fed by a means such as the eye hook 137 shown in FIG. 2 to a merger point 136B where the distal end of the anchor removal line 135 splits into separate sections 136 which loop over anchor ring 132 and are attached at their ends 136A to intermediate locations on fins 121. By way of this arrangement, anchor removal line can be utilized to pull fins 121 into their collapsed or folded position so that the anchor can be more easily removed from the bed of material in which it has been set. Any suitable fastening arrangements such as the swaged ball arrangement 136A can be utilized to fasten the distal end sections 136 of anchor removal line 135 to the fins 121.

Figure 4:
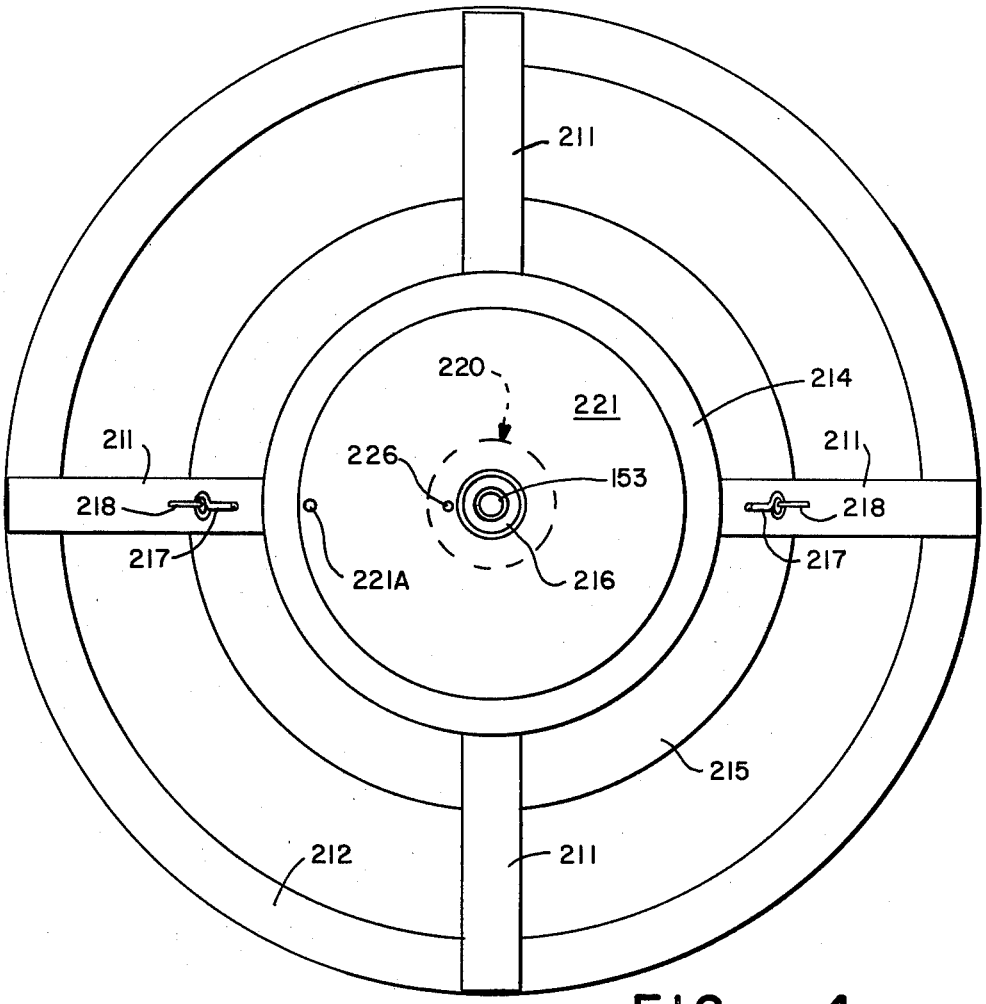
FIG. 4 is a top plan view of an anchor placement stand taken along the lines 4—4 in FIG. 1.
Figure 5:
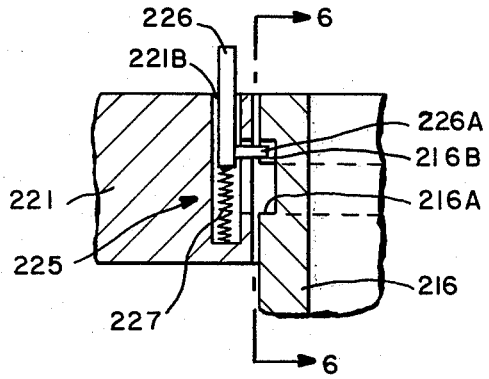
FIG. 5 is an enlarged view of a portion of the placement stand apparatus depicted in FIG. 1.
Figure 6:
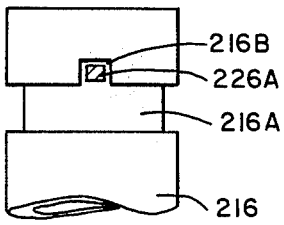
FIG. 6 is a partial section view taken along the lines 6—6 in FIG. 5.

Referring back to FIG. 1, together with FIGS. 4–6, the structure and function of the anchor placement stand assembly 200 will be described. Placement stand assembly 200 generally consists of a stand 210 and a turntable arrangement 220.

The placement stand 210 includes a fixed table arrangement consisting of a bottom table portion 215 and a top table portion 214. As previously noted, the cooperating screw threads on the anchor assembly 100 (specifically anchor head 110) and placement stem 150 comprise cooperative connecting means for releasably connecting the placement stem 150 and the anchor assembly 100. The turntable arrangement 220 provides a releasing means which is operable by the stop means 154 mounted on placement stem 150 for releasing the cooperative connecting means formed by the complementary screw threads to separate the anchor assembly and the placement stem.

Consider first the structure of placement stand 210. A plurality of legs 211 connect the fixed table portions 214 and 215 to a base 212 which consists of a circumferential ring. A plurality of pins 213 may be provided on the underside of base 212 for assisting in maintaining placement stand 210 in position on the surface of the bed of material 10 into which the anchor assembly 100 is to be buried. The respective elements of placement stand 210 may be secured together by any convenient fastening means such as the welds 219 indicated in FIG. 1. Table portion 215 has a hollow stub shaft 216 fastened thereto by an appropriate means such as weld 216A. Hollow stub shaft 216 provides the support for the rotating turntable arrangement 220 and receives placement stem 150 to guide it as anchor assembly 100 is driven into bed 10. A pair of screw eyes 217 may be mounted to the legs 211 of placement stand 210 to connect a placement stand removal line 218 thereto so that, when utilized on the bottom of a body of water, the placement stand may be retrieved utilizing this line.

Consider now the structure and operation of the rotating turntable arrangement 220. Turntable arrangement 220 includes a transversely disposed turntable 221 mounted on a hollow turntable shaft 222. A pair of bearing arrangements 223 is provided for rotatably mounting hollow shaft 222 on stub shaft 216. In this fashion, turntable 221 and shaft 222 are adapted to rotate with respect to stub shaft 216. A coil spring 224 is provided between the exterior surface of stub shaft 216 and the interior surface of turntable shaft 222 with one end 224A of spring 224 connected into stub shaft 216 and the other end 224B of spring 224 connected to turntable shaft 222. This arrangement provides a spring motor means for rotating turntable 221 since spring 224 can be wound up by rotating turntable 221 in a counterclockwise direction viewed from the perspective of FIG. 4. An actuator assembly 225 is provided on turntable 221 to cooperate with a circumferential groove 216A on stub shaft 216 and a key slot 216B thereon both to retain 221 in a locked position with respect to table shaft 216 after spring motor arrangement 224 has been wound and to release turntable 221 for rotation as the stop means 154 on placement stem 153 encounters the turntable 221. The actuator arrangement 225 is more clearly depicted in FIGS. 5 and 6. An actuator element 226 is provided in a vertical channel 221B formed in turntable 221. A spring 227 is provided in the bottom of channel 221B to urge actuator element 226 vertically to position a stop element 226A carried thereon in keyway 216B formed in stub shaft 216.

By means of this arrangement, turntable 221 held against rotation when stop element 226A is in keyway 216B but is free to rotate when actuator element 226 is pushed down until stop means 226A enters the circumferential groove 216A. Accordingly, turntable 221 may be rotated when actuator element 226 is depressed to wind spring motor 224. Then, actuator element 226 may be released into keyway 216B to hold turntable 221 in its position. However, when stop means 154 on placement stem 153 pushes actuator element 226 down, the spring motor 224 will rotate turntable 221 and a drive pin 221A will then cooperate with an aperture 155 in stop means 154 to cause stop means 154 to rotate together with turntable 221. This rotational motion of turntable 221 will unscrew placement stem 150 from anchor assembly 100 and permit the placement stand 200 and placement stem 150 to be together removed by pulling on placement stand removal line 218.

Consider now the overall operation of the self-burying anchor system as shown in FIG. 1. Placement stem 153 will normally be positioned initially such that the tip of anchor assembly 100 is just on the surface of the bed of material 10. The turntable 221 will have previously been turned several times to wind up spring motor 224 with actuator element 226 thereafter restraining turntable 221 from movement. Then fluid under pressure may be supplied to placement stem 153 and anchor head 110 by way of coupling hose 250 attached to placement stem 150 by means of a swivel coupling 160. The fluid under pressure may be water or an air/water mixture and the escape of this pressurized fluid from the jets 112 and 113 in anchor head 110 will cause anchor assembly 100 to begin to bury itself in the bed of material 10. This is accomplished by the action of the fluid passing through the jets 112 and 113, fluidizing the material of the bed and creating a force which drives the anchor assembly 100 further and further into bed 10. While anchor assembly 100 is being driven into the bed by the pressurized fluid escaping the jets therein fins 121 are folded against the placement stem 150, and the anchor ring 132 encircles the distal section 151 of placement stem 150.

Anchor assembly 100 continues to be driven into the bed 10 until stop means 154 thereon encounters turntable 221 on placement stand 200. As actuator 226 is pushed down by the bottom surface of stop means 154, turntable 221 will begin to rotate, driven by spring motor 224. Driving pin 221A will engage with aperture 155 on stop means 154 and begin to turn stop means 154 and placement stem 153 with respect to anchor head 110. after a few turns, anchor head 110 is separated from placement stem 150 and this will be signalled by a drop in pressure of the fluid passing through hose 250. At this time, the supply of pressurized fluid can be turned off and the placement stand removal line 218 may be utilized to lift placement stand assembly 200 and placement stem 150 to the surface of the body of water. Thereafter, anchor line 131 may be pulled to partly retract anchor assembly 100 causing fins 121 thereon to unfold as the projecting ends sections 124 encounter the walls of the cavity 11 formed in bed 10. As fins 121 unfold to their maximum position as depicted in FIG. 3, anchor assembly 100 is set in bed 10. Thereafter the cavity 11 formed by the fluidizing action of the high pressure fluid passing through the jet nozzles in the anchor head will fill in and anchor assembly 100 will be firmly embedded in the bed 10.

Having described the utilization of anchor assembly 100 in connection with the placement stand arrangement 200, it should be apparent that anchor assembly 100 could also be utilized by itself, either with divers assisting in maintaining the placement stem 150 in position during initial driving of anchor assembly 100 into bed 10 or utilizing a long placement stem which reaches to the surface of the water. In such an approach, the placement stem 150 will be manually disconnected from anchor assembly 100 after the anchor assembly has reached its intended depth. A placement stem removal line 170 may be used to retrieve placement stem 150 and then anchor line 131 pulled to set the anchor assembly by unfolding the fins 121.

Figure 7:
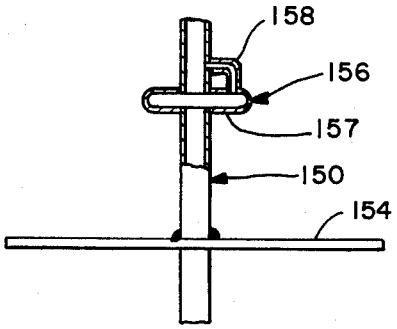
FIG. 7 is a partial section view showing an optional vibrator means for utilization in the anchor system depicted in FIG. 1.

Referring now to FIG. 7, an optional water driven vibrator in the form of an unbalanced turbine is depicted for optional inclusion in the placement stem 150. Water driven vibrator 156 consists of a turbine chamber 157 formed in an upper section 153 of placement stem 150. A water line 158 is connected between a section of placement stem above the turbine chamber 157 into the turbine chamber itself. This water line 158 causes an imbalance in the flow of water entering turbine chamber 157 and produces vibration of the placement stem. This vibration may be utilized under certain conditions to assist in driving the anchor assembly 100 into the bed of material.

While a preferred embodiment of this invention has been disclosed in detail above, it should be understood that numerous modifications in the disclosed embodiment could be made without departing from the scope of the invention as claimed in the following claims.

What is claimed is:

1. In an anchor device adapted to be buried in a bed of material;

an anchor head comprising a generally hollow cylindrical body having an upper portion adapted to be releasably secured to a hollow placement stem connected to a supply of fluid under pressure and a lower portion with a tapered nose and at least one downwardly oriented jet aperture in the lower end of said nose and a plurality of upwardly angled jet apertures in the walls thereof for transmitting said fluid into the bed materials surrounding said nose thereby to fluidize said material and drive said head into said bed;

a fin assembly mounted on said anchor head intermediate said top and bottom portions thereof and comprising a plurality of fins and means for mounting a foot portion of each of said fins for rotation of said fins between a folded position generally parallel to the axis of said anchor head and an unfolded position at a substantial acute angle to said axis; and an anchor line assembly including an anchor line and means fastening said anchor line to said fin assembly to enable said anchor head and fin assembly to be partly retracted from said bed to unfold said fins and thereby set said anchor device in said bed;

said placement stem including a transversely extending stop plate fastened thereto at a preselected distance from said anchor head to determine a maximum burying depth for said anchor device.

2. Apparatus as claimed in claim 1, wherein said mounting means in said fin assembly comprises a fin mounting collar secured to said body of said anchor head and a plurality of fin mounting brackets provided on said collar, each associated with one of said fins and including fastener means for rotationally mounting said foot portion of said associated fin on said bracket.

3. In a self-burying anchor system, a generally hollow anchor placement stem adapted to be connected at a proximal end to a hose supplying a volume of fluid under pressure; a self-burying anchor assembly carried on a distal end of said anchor placement stem for receiving said volume of fluid under pressure to drive said anchor assembly and said placement stem into a bed of material; and a placement stand assembly including a horizontal table with an aperture therethrough receiving said placement stem, said placement stand assembly adapted to rest on the surface of said bed of material for holding said placement stem in a vertical position as said anchor assembly and placement stem are being driven into said bed; cooperative connecting means carried on a distal end of said placement stem and on an upper portion of said anchor assembly for releasably connecting said placement stem and said anchor assembly; stop means carried on said placement stem at a preselected distance from said distal end thereof for stopping the burying of said anchor assembly when said stop means encounters said table on said placement stand assembly; and releasing means carried on said table and operable by said stop means for releasing said cooperative connecting means to separate said anchor assembly and said placement stem.

4. Apparatus as claimed in claim 3, wherein said cooperative connecting means comprises cooperative screw threads on said distal end of said placement stem and said upper portion of said anchor assembly for connecting said placement stem and said anchor assembly while said anchor assembly is driving into said bed; said releasing means comprises a turntable, means for mounting said turntable in rotatable fashion on said table, means carried on said turntable for locking said turntable and said stop means together when said stop means encounters said turntable, spring motor means operable to rotate said turntable and said stop means when locked together, and actuator means for initiating rotation of said turntable by said spring motor means as said stop means encounters said turntable, thereby to unscrew said cooperative screw threads on said placement stem and said anchor assembly and disconnect said placement stem from said anchor assembly.

5. Apparatus as claimed in any of claims 3 and 4, wherein said anchor assembly includes an anchor head comprising a generally hollow cylindrical body having a bottom portion with a tapered nose and at least one downwardly oriented jet aperture in the lower end of said nose and a plurality of upwardly angled jet apertures in the walls thereof for transmitting said fluid into the bed materials surrounding said nose, thereby to fluidize said material and drive said head into said bed; a fin assembly mounted on said anchor head adjacent said bottom portion thereof and comprising a plurality of fins and means for mounting a foot portion of each of said fins for rotation of said fins between a folded position generally parallel to the axis of said anchor head and an unfolded position at a substantial acute angle to said axis; and an anchor line assembly including an anchor line and means fastening said anchor line to said fin assembly to enable said anchor assembly to be partly retracted from said bed to unfold said fins and thereby set said anchor device in said bed.

6. Apparatus as claimed in claim 5, wherein said mounting means in said fin assembly comprises a fin mounting collar secured to said body of said anchor head and a plurality of fin mounting brackets provided on said collar, each associated with one of said fins and including a fastener means for rotationally mounting said foot portion of said associated fin on said bracket.

7. Apparatus as claimed in claim 6 wherein said fastening means in said anchor line assembly includes an anchor ring fastened to said anchor line and adapted to encircle said placement stem, and at least one coupling line fastened on one end to said anchor ring and on the other end to said fin assembly, said anchor line assembly further comprising an anchor removal line having a split distal end section comprising individual lines each attached on one end to an associated one of said fins at an intermediate point thereof and passing over said anchor ring to a merger point on said anchor removal line, and means mounted on said fin mounting collar for feeding said anchor removal line from said merger point to a proximal location such that said anchor removal line may be pulled to return said fins to a folded position for removal of the anchor assembly from said bed of material.

8. Apparatus as claimed in claim 6, wherein each of said foot portions of said fins includes a wall section forming an acute angle with a longitudinal axis of said fins to serve as a fin stop means for setting the maximum unfolded angle of said fin when said angular wall portion abuts said fin mounting collar.

9. In an anchor device adapted to be buried in a bed of material;

an anchor head comprising a generally hollow cylindrical body having an upper portion adapted to be releasably secured to a hollow placement stem connected to a supply of fluid under pressure and a lower portion with a tapered nose and at least one downwardly oriented jet aperture in the lower end of said nose and a plurality of upwardly angled jet apertures in walls thereof for transmitting said fluid into the bed materials surrounding said nose thereby to fluidize said material and drive said head into said bed;

a fin assembly mounted on said anchor head intermediate said top and bottom portions thereof and comprising a plurality of fins and means for mounting a foot portion of each of said fins for rotation of said fins between a folded position generally parallel to the axis of said anchor head and an unfolded position at a substantial acute angle to said axis; and an anchor line assembly including an anchor line and means fastening said anchor line to said fin assembly to enable said anchor head and fin assembly to be partly retracted from said bed to unfold said fins and thereby set said anchor device in said bed;

said mounting means in said fin assembly comprising a fin mounting collar secured to said body of said anchor head and a plurality of fin mounting brackets provided on said collar, each associated with one of said fins and including fastener means for rotationally mounting said foot portion of said associated fin on said bracket;

said fastening means in said anchor line assembly including an anchor ring fastened to said anchor line and adapted to encircle said placement stem, and at least one coupling line fastened on one end to said anchor ring and on the other end to said fin assembly, and said anchor line assembly further comprising an anchor removal line having a split distal end section comprising individual lines each attached on one end to an associated one of said fins at an intermediate point thereof and passing over said anchor ring to a merger point on said anchor removal line, and means mounted on said fin mounting collar for feeding said anchor removal line from said merger point to a proximal location such that said anchor removal line may be pulled to return said fins to a folded position for easier removal of the anchor device from said bed of material.

10. Apparatus as claimed in claim 2 or claim 9, wherein each of said foot portions of said fins includes a wall section forming an acute angle with the longitudinal axis of said fin to serve as a fin stop means for setting the maximum unfolded angle of said fin when said angular wall portion abuts said fin mounting collar.

* * * * *